US005854470A

United States Patent [19]

Silva

[11] Patent Number: 5,854,470

[45] Date of Patent: Dec. 29, 1998

[54] SNOW MELTING MAT SYSTEM

[76] Inventor: Percy Silva, 151 Pacific St. Apt. 8, Paterson, N.J. 07503

[21] Appl. No.: 840,243

[22] Filed: Apr. 17, 1997

[51] Int. Cl.[6] ..... A47B 97/00

[52] U.S. Cl. ..... 219/528; 219/535; 219/548; 428/209

[58] Field of Search ..... 219/211, 528, 219/535, 548, 549, 546; 428/209, 408

[56] References Cited

U.S. PATENT DOCUMENTS 4,844,072 7/1989 French ..... 219/528

4,904,846 2/1990 Oscadal ..... 219/528

5,614,292 3/1997 Saylor ..... 219/546

*Primary Examiner*—Teresa J. Walberg

*Assistant Examiner*—Quan Nguyen

[57] ABSTRACT

A new Snow Melting Mat System for melting snow and ice near a walking path thereby preventing slipping of individuals. The inventive device includes a mat having a plurality of drain slots, a tube projecting within the mat, a pump connected to both ends of the tube for circulating heated oil, and a heating coil surrounding a portion of the tube for heating the oil within the tube during circulation.

8 Claims, 4 Drawing Sheets

SNOW MELTING MAT SYSTEM

BACKGROUND OF THE INVENTION

1. Field of the Invention

The present invention relates to Snow Melting Devices and more particularly pertains to a new Snow Melting Mat System for melting snow and ice near a walking path thereby preventing slipping of individuals.

2. Description of the Prior Art

The use of Snow Melting Devices is known in the prior art. More specifically, Snow Melting Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Snow Melting Devices include U.S. Pat. No. 5,380,988; U.S. Pat. No. 4,967,057; U.S. Pat. No. 5,003,157; U.S. Pat. No. Design 356,228; U.S. Pat. No. 4,258,248; and U.S. Pat. No. 5,291,000.

While these devices fulfill their respective, particular objectives and requirements, the aforementioned patents do not disclose a new Snow Melting Mat System. The inventive device includes a mat having a plurality of drain slots, a tube projecting within the mat, a pump connected to both ends of the tube for circulating heated oil, and a heating coil surrounding a portion of the tube for heating the oil within the tube during circulation.

In these respects, the Snow Melting Mat System according to the present invention substantially departs from the conventional concepts and designs of the prior art, and in so doing provides an apparatus primarily developed for the purpose of melting snow and ice near a walking path thereby preventing slipping of individuals.

SUMMARY OF THE INVENTION

In view of the foregoing disadvantages inherent in the known types of Snow Melting Devices now present in the prior art, the present invention provides a new Snow Melting Mat System construction wherein the same can be utilized for melting snow and ice near a walking path thereby preventing slipping of individuals.

The general purpose of the present invention, which will be described subsequently in greater detail, is to provide a new Snow Melting Mat System apparatus and method which has many of the advantages of the Snow Melting Devices mentioned heretofore and many novel features that result in a new Snow Melting Mat System which is not anticipated, rendered obvious, suggested, or even implied by any of the prior art Snow Melting Devices, either alone or in any combination thereof.

To attain this, the present invention generally comprises a mat having a plurality of drain slots, a tube projecting within the mat, a pump connected to both ends of the tube for circulating heated oil, and a heating coil surrounding a portion of the tube for heating the oil within the tube during circulation.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Snow Melting Mat System apparatus and method which has many of the advantages of the Snow Melting Devices mentioned heretofore and many novel features that result in a new Snow Melting Mat System which is not anticipated, rendered obvious, suggested, or even implied by any of the prior art Snow Melting Devices, either alone or in any combination thereof.

It is another object of the present invention to provide a new Snow Melting Mat System which may be easily and efficiently manufactured and marketed.

It is a further object of the present invention to provide a new Snow Melting Mat System which is of a durable and reliable construction.

An even further object of the present invention is to provide a new Snow Melting Mat System which is susceptible of a low cost of manufacture with regard to both materials and labor, and which accordingly is then susceptible of low prices of sale to the consuming public, thereby making such Snow Melting Mat System economically available to the buying public.

Still yet another object of the present invention is to provide a new Snow Melting Mat System which provides in the apparatuses and methods of the prior art some of the advantages thereof, while simultaneously overcoming some of the disadvantages normally associated therewith.

Still another object of the present invention is to provide a new Snow Melting Mat System for melting snow and ice near a walking path thereby preventing slipping of individuals.

Yet another object of the present invention is to provide a new Snow Melting Mat System which includes a mat having a plurality of drain slots, a tube projecting within the mat, a pump connected to both ends of the tube for circulating heated oil, and a heating coil surrounding a portion of the tube for heating the oil within the tube during circulation.

Still yet another object of the present invention is to provide a new Snow Melting Mat System that reduces the amount of physical labor required by a user to safely clean a walkway.

Even still another object of the present invention is to provide a new Snow Melting Mat System that reduces the amount of snow and ice tracked into a building structure by visitors.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
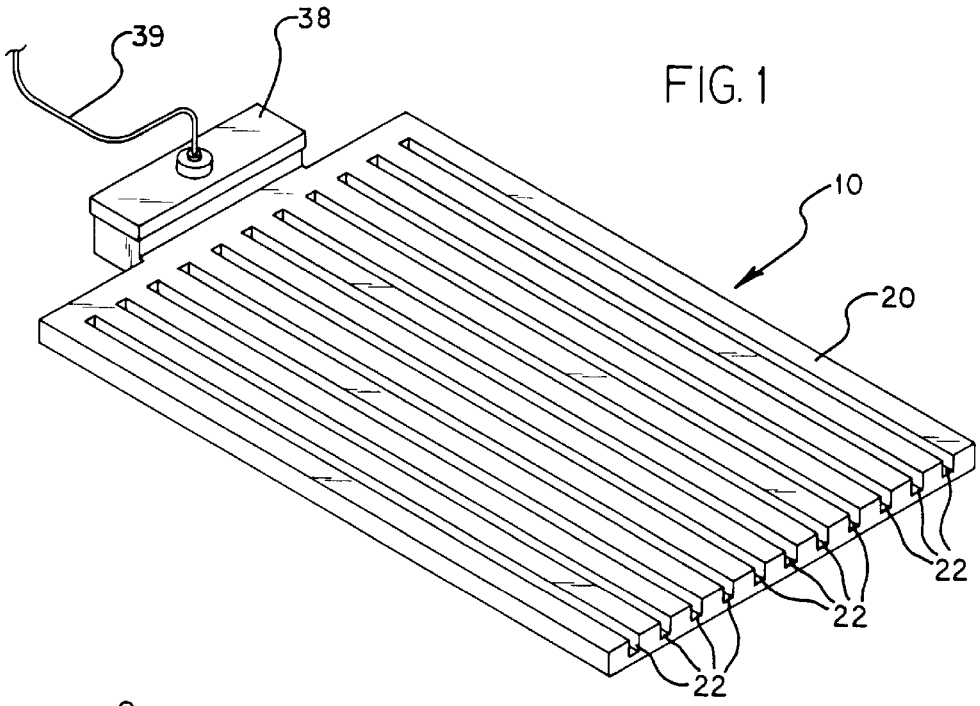
FIG. 1 is an upper perspective view of a new Snow Melting Mat System according to the present invention.

With reference now to the drawings, and in particular to FIGS. 1 through 10 thereof, a new Snow Melting Mat System embodying the principles and concepts of the present invention and generally designated by the reference numeral 10 will be described.

Figure 2:
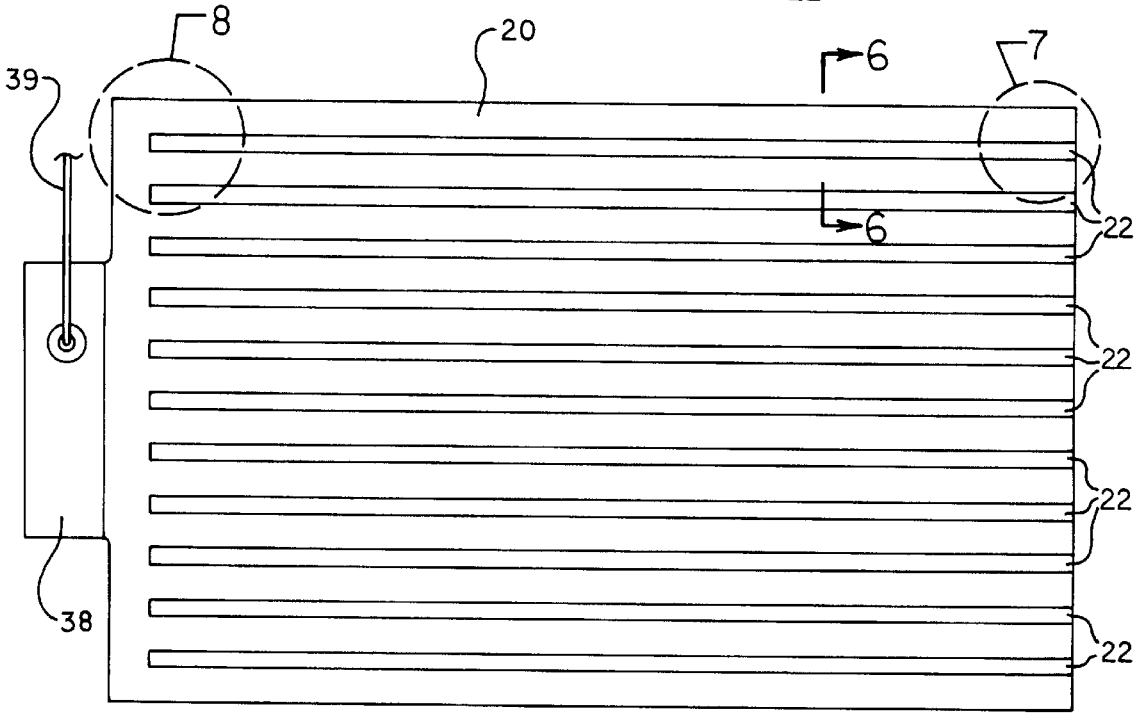
FIG. 2 is a top view of the present invention.
Figure 3:
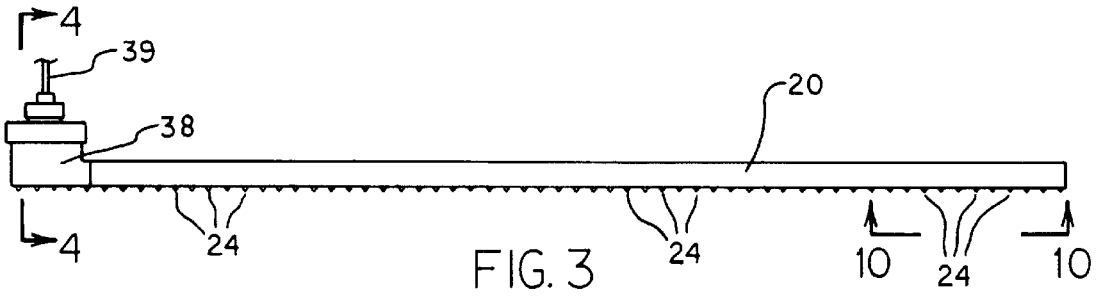
FIG. 3 is a side view of the present invention.
Figure 4:
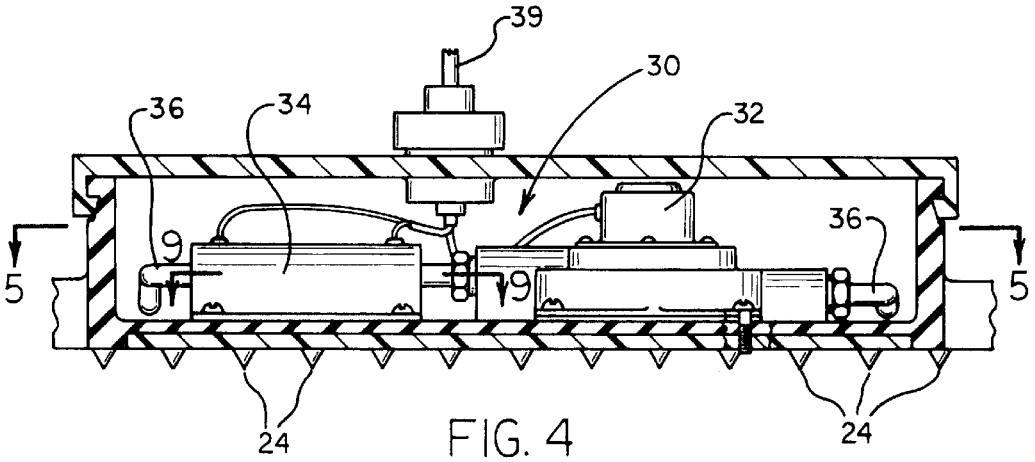
FIG. 4 is a cross sectional view taken along line 4—4 of FIG. 3.
Figure 10:
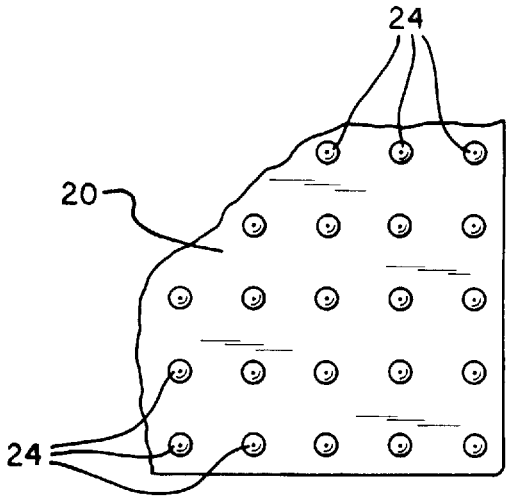
FIG. 10 is cross sectional view taken along line 10—10 of FIG. 3.

As best illustrated in FIGS. 1 through 6, the Snow Melting Mat System 10 comprises a mat 20 substantially swaged and formed for positioning along a walkway, and a heating means 30 positioned within the mat 20 for heating the mat 20 thereby melting accumulated snow or ice for preventing slipping of an individual. The mat 20 preferably has a plurality of drain slots 22 projecting into a top surface thereof as best shown in FIGS. 1 and 2. A plurality of nubs 24 are secured to a bottom surface of the mat 20 for gripping the walkway as shown in FIGS. 3, 4 and 10 of the drawings. The mat 20 is preferably constructed from a non-slip rubber.

Figure 5:
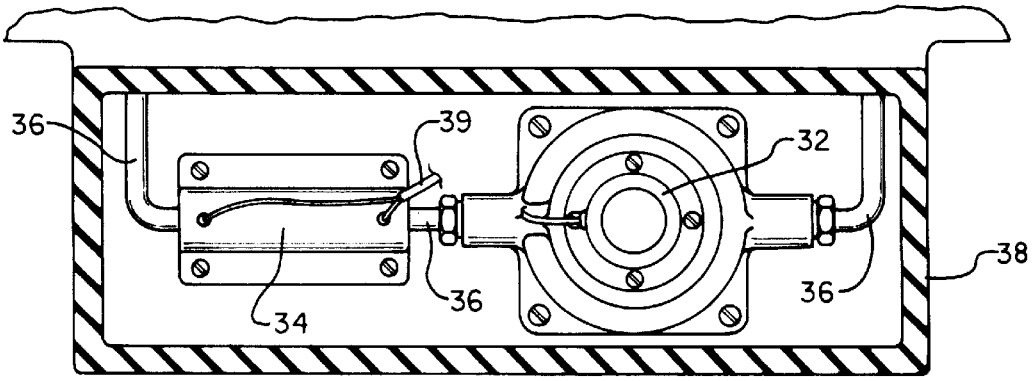
FIG. 5 is a cross sectional view taken along line 5—5 of FIG. 4.
Figure 6:
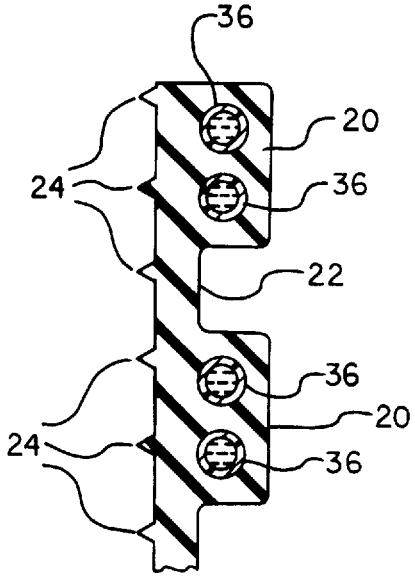
FIG. 6 is a cross sectional view taken along line 6—6 of FIG. 2.
Figure 7:
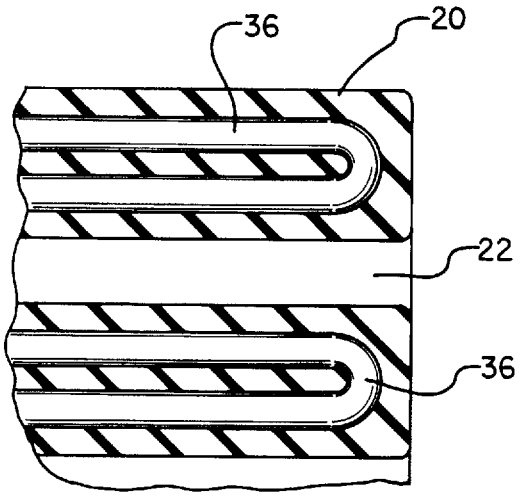
FIG. 7 is a magnified cut-away view from FIG. 2.
Figure 8:
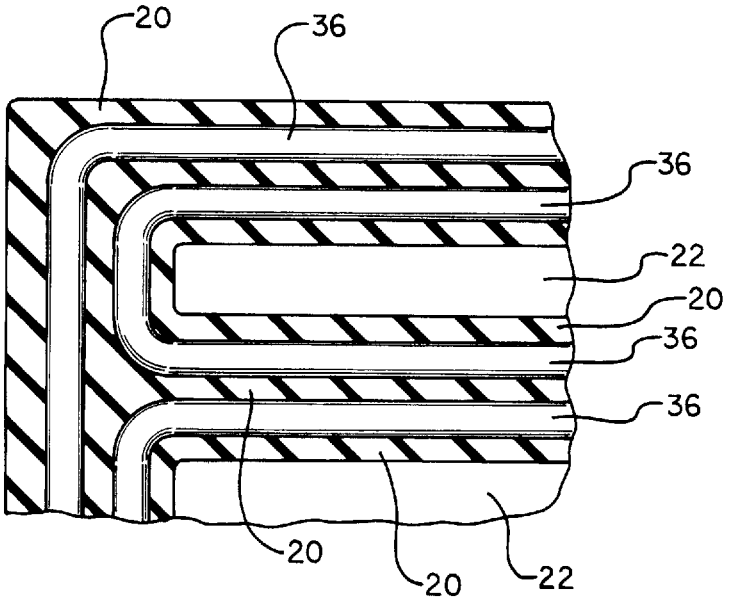
FIG. 8 is a magnified cut-away view from FIG. 2.
Figure 9:
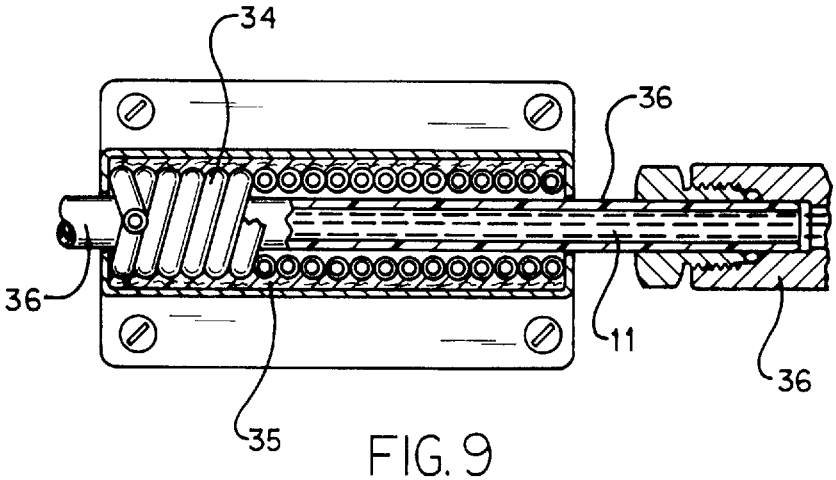
FIG. 9 is a cross sectional view taken along line 9—9 of FIG. 4.

As shown in FIGS. 3 through 9, the heating means 30 comprises a length of tube 36 having an inlet end and an outlet end. The tube 36 is substantially positioned within the mat 20 as best shown in FIG. 7. A housing 38 is secured to an end of the mat 20 as shown in FIGS. 1 through 5. A pump 32 is connected to the inlet end and the outlet end of the tube 36. The pump 32 is positioned within the housing 38, wherein the pump 32 is for circulating oil 12 within the tube 36. A heating coil 34 surrounds a finite length of the tube 36 exposed within the housing 38 and adjacent to the outlet end of the tube 36 for heating the oil 12 contained within the tubing as shown in FIGS. 4, 5 and 9 of the drawings. Insulation 35 preferably surrounds the heating coil 34 as shown in FIG. 9 of the drawings. A power cord 39 is electrically connected to the pump 32 and the heating coil 34 as shown in FIGS. 1 through 5 of the drawings.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A snow melting mat, comprising:

a mat substantially swaged and formed for positioning along a walkway; and a heating means positioned within said mat for heating said mat thereby melting accumulated snow or ice for preventing slipping of an individual;

wherein said mat has top and bottom surfaces with a plurality of drain slots projecting into said top surface of the mat such that said slots form a plurality of elongate ridges, each of said ridges having an upper surface oriented substantially parallel to each other and to said bottom surface, said slots each having a lower surface oriented substantially parallel to the upper surfaces of said ridges;

wherein said heating means a positioned in said ridges between a plane formed by the upper surfaces of said ridges and a plane formed by the lower surfaces of said slots to thereby concentrate the heat transferred from said top surface of said mat and minimize the heating of water in said slots.

2. The snow melting mat of claim 1, wherein wherein the bottom surface of said mat includes a plurality of downwardly projecting numbs for resisting lateral movement of said mat when resting on a surface.

3. The snow melting mat of claim 2, wherein said heating means comprises:

a length of tube having an inlet end and an outlet end, said tube is substantially positioned within said mat, a housing secured to an end of said mat, a pump connected to said inlet end and said outlet end of said tube;

wherein said pump is positioned within said housing, wherein said pump is for circulating oil within said tube; and a heating coil surrounding a finite length of said tube exposed within said housing and adjacent to said outlet end of said tube for heating said oil contained within said tubing.

4. The snow melting mat of claim 3, including insulation surrounding said heating coil.

5. The snow melting mat of claim 4, including a plurality of nubs secured to a bottom surface of said mat for gripping said walkway.

6. The snow melting mat of claim 5, wherein said mat is constructed of a non-slip rubber.

7. A snow melting mat, comprising:

a mat formed for positioning along a walkway, said mat having a plurality of ridges disposed from an unridged portion of said mat, each of said ridges being substantially parallel to each other and substantially perpendicular to said unridged portion of said mat whereby a plurality of drain slots is formed between said ridges;

a length of tube being substantially positioned within said mat, said tube extending substantially into a full length of each of said plurality of ridges, said tube having an inlet end and an outlet end, said inlet and said outlet end extending outwardly from an end of said mat proximate said unridged portion;

a housing secured to the end of said mat proximate said unridged portion, said inlet end and said outlet end extending into said housing;

a pump positioned within said housing, said pump being connected to said inlet end and said outlet end of said tube for circulating heated oil through said tube;

a heating coil positioned in said housing, said heating coil surrounding a finite length of said tube exposed within said housing and adjacent to said outlet end of said tube for heating said oil contained within said tubing;

insulation surrounding said heating coil;

a plurality of nubs secured to a bottom surface of said mat for gripping said walkway; and wherein said mat is constructed of a non-slip rubber.

8. The snow melting mat of claim 1, wherein the upper surfaces of each of said ridges is approximately twice the size of the lower surface of each of said slots to maximize the area of the top surface of said mat for foot contact.

* * * * *